United States Patent [19]

Bradley et al.

[11] 4,236,268

[45] Dec. 2, 1980

[54] TECHNIQUE AND ARTICLES FOR FORMING SHOE SHANKS

[75] Inventors: Robert W. Bradley, Marblehead; Donald L. Bray, Beverly; Raymond L. Peterson, Beverly Farms, all of Mass.

[73] Assignee: Bush Universal, Inc., Woburn, Mass.

[21] Appl. No.: 842,242

[22] Filed: Oct. 14, 1977

Related U.S. Application Data

[62] Division of Ser. No. 681,562, Apr. 29, 1976, Pat. No. 4,081,917.

[51] Int. Cl.[3] ..... A43D 0/00

[52] U.S. Cl. ..... 12/146 S

[58] Field of Search ..... 12/146 R, 146 S, 146 D; 36/76 R, 68, 69

[56] References Cited

U.S. PATENT DOCUMENTS

| | | | |
|---|---|---|---|
| 2,294,982 | 9/1942 | Hathaway | 36/76 R |
| 2,352,520 | 6/1944 | Dawson | 12/146 S |
| 2,371,322 | 3/1945 | Toothader | 12/146 S |

*Primary Examiner*—Patrick D. Lawson

*Attorney, Agent, or Firm*—Wolf, Greenfield & Sacks

[57] ABSTRACT

A strip which will form a rigid shoe shank is applied to the bottom of an insole. The shank strip is flexible and includes a carrier sleeve which contains a plurality of fiberglass strands in a thermosetting plastic matrix. After the shank strip is in place, the matrix is activated by exposing it to an external stimulus such as heat or radiation. Heat can be applied locally to the shank strip and curing takes place directly on the insole bottom. The thermosetting resin can polymerize with or without an exothermic reaction. Preferably, sufficient heat is developed from exothermic heat or from the energy source and directed to melt the carrier sleeve to fuse it with the resin and to effect a bond to the insole for forming a unitary and rigid shank attached firmly to the insole bottom. The shank strip may be cut from a "rope" which may be wound onto a reel for storage and to facilitate continuous paying out of the rope to enable a shank length to be severed and applied to the insole bottom.

29 Claims, 20 Drawing Figures

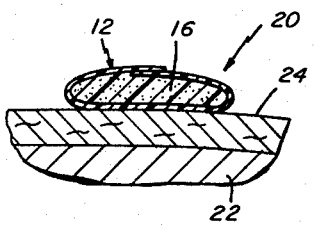
Fig. 17
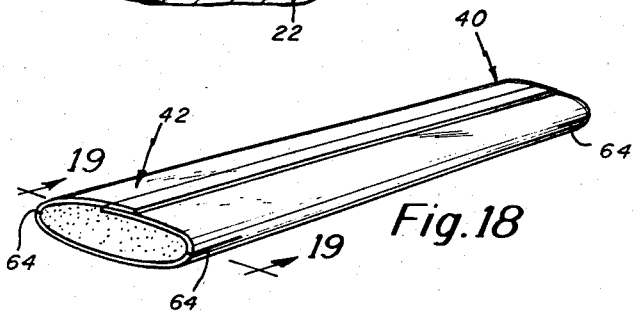
Fig. 18
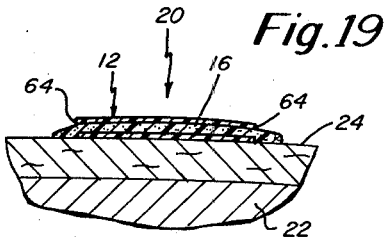
Fig. 19
Fig. 20
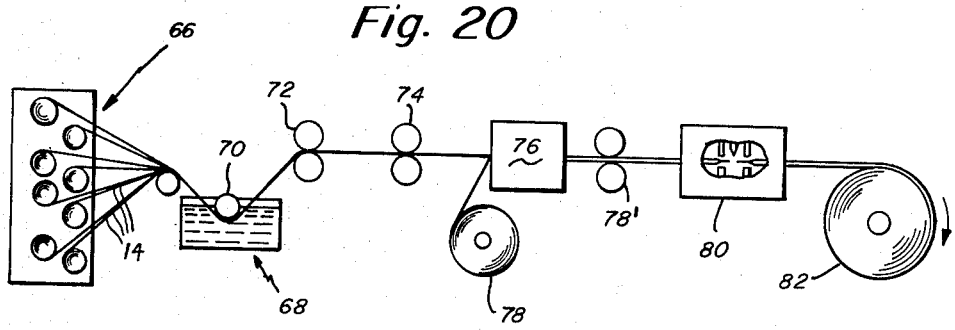

TECHNIQUE AND ARTICLES FOR FORMING SHOE SHANKS

This is a division of application Ser. No. 681,562, filed Apr. 29, 1976, now U.S. Pat. No. 4,081,917.

BACKGROUND OF THE INVENTION

This invention relates to shoe manufacture and, particularly, to improvements in stiffening the shank region of the shoe which extends from the heel to the ball portions. Most shoes typically require some means to rigidify and stiffen the shank region. It has been substantially universal practice for many decades to stiffen the shank region by attaching a preformed steel, wood or wood on fiber shank piece to the bottom of the insole of a lasted shoe assembly, before the outsole is attached so that after attachment of the outsole, the shank lies between the insole and outsole.

The use of preformed shanks such as steel shanks for this purpose has and still does present numerous problems. Because of the wide variety of shapes, sizes and styles of shoes, the manufacturer is required to maintain a very substantial inventory of preformed shanks. In order to insure an adequate supply of the various shanks which may be required at any time it is not uncommon for a manufacturer to overstock his inventory. Not infrequently, a manufacturer finds that a certain style or configuration of shank piece is no longer useable because of continually changing shoe styles.

It is common shoe industry practice to make a "case" of shoes at the same time in which the shoes in the case are of varying styles and sizes. A machine operator applying shanks to the bottoms of the insoles of the shoes in the case typically will have before him a wide variety of preformed shank pieces from which he must select the proper one to correspond to the particular shoe on which he is working. There is a reasonable chance that the operator may select the wrong shank piece for the particular shoe. Mismatching of the shank and shoe presents complications in the subsequent manufacturing steps of that shoe as well as further difficulties with the shoe after it has been completed and when it is worn. Moreover, even when the proper shank piece has been selected from a particular shoe, it is not uncommon for the shank piece to fail to fit the curve of the last and insole with the degree of conformity which is desired.

Also among the difficulties encountered with preformed steel shank pieces is that they must be placed on the insole in precisely the right location. They are typically attached to the insole at one or two specific locations, as by a nail, or adhesive, or a combination. Failure to properly place the shank often interferes with subsequent nailing operations, for example, when nailing the heel to the shoe. In general, the preformed shank pieces are difficult to place and require a significant degree of operator skill.

Even when a shoe having a steel shank is properly manufactured, the steel shank may present difficulty when the shoe is worn. After a time, the steel shank piece may work its way loose from the repetitive flexing and the shoe develops a squeak when worn. Remedial efforts to avoid a squeaky shoe have included taping of the steel shank piece in the hope that even if the shank does work loose, the taped shank piece will be less likely to rub against either or both of the insole and outsole. While this sometimes is effective, at least until the tape itself wears through, it does add to the cost and difficulty in manufacture of the shoe.

A further difficulty sometimes encountered with preformed steel shank shoes is that the steel shank can be felt by the wearer. Efforts to overcome this have included the addition of a sheet or layer of cushioning material (sometimes called a "tuck") interposed between the shank and the insole. Here, again this adds to the cost and only further complicates the manufacturing procedure.

THE PRIOR ART

The foregoing and other difficulties inherent in the use of preformed steel shanks have been recognized in the art for many years and numerous efforts, suggestions and proposals have been made to remedy these difficulties. All have failed as evidenced by still substantially universal practice in the shoe industry of employing preformed wood or steel shanks.

For example, U.S. Pat. No. 235,541 to Leonard issued Dec. 14, 1880 complains of difficulties which steel shanks present in repairing shoes.

U.S. Pat. No. 1,327,091 to Egerton issued Jan. 6, 1920 suggests that the shank might be made to fit the insole better if it is preformed from a moldable material, perhaps more easily formed and more easily penetrable by nails to facilitate fastening to the shoe bottom.

U.S. Pat. No. 2,173,971 to Lancaster issued Sept. 26, 1939 proposed attaching to the heel of a shoe by a cement and sawdust mixture in a manner in which, when the heel is applied to the heel seat of the shoe forces some of the cement-sawdust mixture into the space in the shank region of the shoe.

U.S. Pat. No. 2,200,401 to Stritter issued May 14, 1940 evidences still further the need for an alternative to the steel shank and suggested applying a strip of initially stiff material, softening it and applying it to the insole bottom in its softened state, applying a molding roller to the softened strip to conform the strip to the contour of the insole bottom and then permitting and causing the material to harden.

U.S. Pat. No. 2,269,562 to Stritter issued Jan. 13, 1942 shows still further efforts to find an acceptable substitute for the metal shank by forming the rear portion of the insole to define an elongate cavity and then filling that cavity with a hardenable material.

U.S. Pat. No. 2,294,982 to Hathaway issued Sept. 8, 1942 suggests a moldable shank stiffener in the form of an initially rigid thermoplastic rod encased within a foraminous metal tube and in which a length of the rod is severed and molded under head and pressure to preliminarily mold the shank strip. The pre-molded shank strip then is applied to the insole bottom and is pressed against the insole bottom by a heated mold.

U.S. Pat. No. 2,426,707 to Wagner issued Aug. 12, 1947 shows still further attempts to satisfy the desire to do away with the preformed steel shank piece by simply extruding a flowable hot melt thermoplastic directly onto the insole bottom and permitting it to cool to its hardened state.

U.S. Pat. No. 2,832,976 to Huprich issued May 6, 1958 acknowledges the difficulties encountered with steel shanks as well as the problems presented by the prior art proposals to eliminate the use of steel shanks. This patent suggests impregnating each of a plurality of twisted fiberglass bundles with a thermosetting resin and then placing the plurality of fiberglass bundles on the insole bottom parallel to each other, then placing the outsole of the shoe bottom and permitting the resin to cure.

U.S. Pat. No. 3,442,032 to Jonas issued May 6, 1969 suggests forming a shank stiffener by extruding a thermoplastic material reinforced with glass fibers against the shank region of the insole bottom and molding it to the intended contour by a beating device.

U.S. Pat. No. 3,481,820 to Jonas issued Dec. 2, 1969 acknowledges some of the difficulties encountered with steel shanks and also acknowledges the problems encountered in the prior efforts to employ various types of plastic, molded-on shanks. This patent suggests stiffening the shank region of the shoe by applying a thermoplastic material to the insole before any lasting operations, then heating the thermoplastic portion and then pressing it to the last bottom to conform it to the desired shape and permitting it to harden in the conformed shape.

Although there has been a long felt need for an effective replacement for the steel shank, no workable technique or system has yet been developed. The almost ancient practice of attaching a preformed shank such as a steel shank piece still is widespread and is almost universally employed in the manufacture of shoes. Although very substantial research and development efforts have been made to apply a plastic mass to an insole bottom, mold it and cure it in situ, all have run into serious difficulties which have precluded their use commercially. Among the more difficult of these problems has been in handling the plastic mass particularly when the plastic is in the form of a fluent, tacky resin. Machine parts tend to gum up with the resin and become inoperative. Difficulties have been encountered with regard to premature or tardy setting or curing of thermosetting resins. A further problem with some of the prior techniques is that in the application, molding or curing of the resin temperatures are reached which can damage the shoe materials. In those instances where the shoe has already been lasted by a thermoplastic adhesive, as is common practice, the elevated temperatures required may soften the thermoplastic adhesive bonding of other of the shoe parts and can cause them to delaminate or otherwise shift from their orginally attached positions.

It is among the general objects of the invention to provide a system including new and improved articles of manufacture and methods by which a shank stiffener may be placed and formed in situ on the bottom of an insole of a lasted shoe assembly and which avoids the foregoing and other difficulties which has thusfar been insurmountable in substantial commercial practice.

SUMMARY OF THE INVENTION

The invention employs a shank strip comprising a mass of reinforcing fiber strands embedded in a matrix of a thermosetting resin and catalyst mixture, surrounded by and enclosed in an elongate sleeve impermeable to the mixture. The sleeve preferably is of thermoplastic material and the strands are preferably parallel fiberglass strands. The shank strip may be cut from an elongate rope of the material, which may be packaged and stored on a reel until ready for use. The thermoplastic sleeve precludes evaporation of any of the fluent materials in the matrix and provides a long shelf life. In use, a shank strip of desired length is cut from the rope and applied to the shank region of the insole bottom. In one aspect of the invention, the bottom, insole-engaging surface of the rope may be slit or perforated to expose the resinous matrix directly to the insole bottom so that it may act as an adhesive. In an alternative technique, the outer surface of the sleeve may be coated with an adhesive to facilitate temporary placement and attachment of the shank strip to the insole. In another case, the insole can be precoated with an adhesive. The shank strip is pressed lightly into conformity with the insole bottom contour. When the strip is in place, the thermosetting resinous matrix is activated by an external stimulus such as exposure to ultraviolet, infrared or high radio frequency radiation or by applying heat in any manner such as by conductive heating. The heat is preferably applied locally to the shank strip and not to other parts of the shoe, for example, by a radiant heater and in a manner which focuses, shields or otherwise confines the radiant heat to the shank strip to avoid heating other parts of the shoe assembly which may be attached with a thermoplastic adhesive. The shank strip may be pre-heated before it is applied to the shoe, for example, to a temperature of the order of 150° F., and then applied to the shoe. The strip then may be locally exposed, while on the shoe, to a final heating to the activation temperature, for example, 200° F. to 275° F. preferably for a very brief interval, for example, two to four seconds. The thermoplastic sleeve is preferably transparent and/or non-absorbing to the radiant energy to enable direct heating of the resinous matrix. The resin can be exothermic so that as it polymerizes and/or crosslinks its temperature will be raised well above the melt temperature of the thermoplastic sleeve to a level sufficient to cause the thermoplastic sleeve to fuse in with and/or cross link with the thermosetting matrix. The reaction also effects a full and complete bond of the shank strip to the insole bottom. The heat generated by the exothermic reaction can be localized within the shank strip and does not adversely affect any nearby shoe parts which may have been bonded by thermoplastic adhesive. In some cases the sleeve withstands the exothermic and activating temperatures and remains in the final product.

DESCRIPTION OF THE DRAWINGS

The foregoing and other objects and advantages of the invention will be understood more fully from the following further description thereof, with references to the accompanying drawings wherein:

FIG. 17 is a transverse sectional illustration of the shank strip applied to the insole bottom without any slitting or perforations in the sleeve;

FIG. 18 is an illustration of a shank strip in which the sleeve has been slit at each of its ends on its opposite transverse sides to facilitate spreading and feathering of the ends of the shank strip;

FIG. 19 is a transverse section of the flattened, feathered end of the shank strip of FIG. 18; and FIG. 20 is a somewhat diagrammatic illustration of the manner in which the rope may be manufactured and wound on a reel.

DESCRIPTION OF THE PREFERRED EMBODIMENTS

Figure 1:
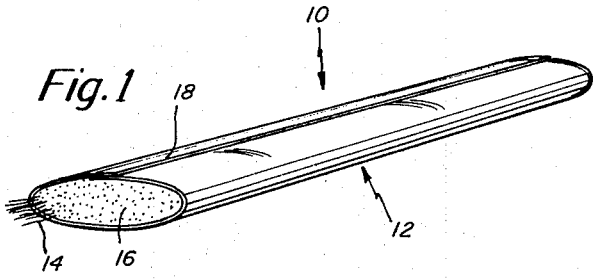
FIG. 1 is an illustration of a portion of the rope.

FIG. 1 shows a segment of the rope, indicated generally by the reference character 10, used in the practice of the invention. The rope includes an elongate outer carrier sheath or sleeve 12 which contains a multiplicity of elongate fiber strands 14 embedded in a fluid matrix 16 composed of a thermosetting resin and catalyst which will not polymerize or crosslink under ambient conditions over long shelf lives of for example three months or more. The rope 10 is flexible and long lengths of it, for example, hundreds of feet, may be wound on a reel to facilitate manufacture of the rope, storage, handling and subsequent use. The ends of the reeled-up rope are preferably sealed. Depending on the technique employed for fabricating the rope, the sleeve 12 may have a longitudinal lapped seam 18.

The rope 10 may be of somewhat flat, ribbon-like shape being of the order of from 3/32" to ⅜" thick and approximately ⅜" to 1" wide. The rope preferably has a cross sectional area of from 0.03 to 0.38 square inches.

The matrix 16 in which the fiber strands 14 are embedded is a thermosetting resin material in fluid or semi-fluid form. Matrix resin material viscosities of from 150 centipoises to 1350 poises (as measured on a Brookfield viscometer at 77° F. RVF Spindle #7) are preferred. The matrix resins can be hardened into cross-linked polymerized materials having hardness values of from 40 to 80 Barcol. Particularly suitable thermosetting resins useful in this invention are the unsaturated polyester resins which are the products of chemical condensation of organic glycols and organic unsaturated dibasic acids produced by esterification. The polyesters are formed from glycols such as propylene glycol, dipropane glycol, ethylene glycol, diethylene glycol, neopentyl glycol or combinations thereof reacted with dibasic acids such as maleic acid. Other common additives to such polyester resins may also be employed such as saturated acids and organic products including phthalic anhydride, isophthalic acid, adipic acid and others which are commonly used to control the degree of unsaturation in the polyester which in turn controls the cross-linking and physical properties of the finally cured resin and the speed of curing possible.

Organic unsaturated monomers are used as solvents for the polyesters and are reactive therewith in cross-linking and polymer formation. These monomers are also useful to adjust precured viscosity to within the range noted above. Preferably styrene is the monomer of choice for use in the present invention. However, monomers such as methyl methacrylate, diallyl phthalate, vinyl toluene and the like as known in the art can be used. The monomers are mixed with the polyesters preferably in amounts of from 30% to 65% by weight of the total resin mixture to achieve viscosities of from 1350 poises to 150 centipoises allowing thorough incorporation of the fibers and desired flexibility of the final rope.

The thermosetting resin mixture 16 can also have incorporated therewith suitable promoters to assist the catalyst in production of nascent oxygen, catalysts or catalysts mixtures to produce nascent oxygen, thixotropic agents where necessary to preserve viscosity and other conventional additives.

Inhibitors can be used as known in the art to prevent premature reactions. Such inhibitors include substituted hydroquinones such as p-benzoquinone, p-tert-butylcatechol, monomethyl ether, 2,6-di-t-butyl-p-cresol and others commonly known in the art. These inhibitors are preferably used in amounts of from 0.0025% to 0.015% by weight of the resin mixture and prolong shelf life of the product so that ease of handling and flexibility is maintained over periods up to six months at ordinarily encountered room temperature conditions.

The catalysts used can be any of the known free radical initiators or combinations thereof including the peroxides such as 1,1 Di-t-butyl Peroxy-3,3,5 Trimethylcyclohexane, 1,1-Di-(t-butylperoxy)cyclohexane, t-butyl-perbenzoate and t-butyl peroctoate or mixtures of these catalyst and other peroxides. Peroxy ketal materials such as 1,1-Bis(t-Butyl Peroxy)Cyclohexane and the like are preferred with styrene polyester syrups while t-butyl perbenzoate is preferred for use with diallylphthalate syrups.

The catalyst is preferably used in amounts of from 0.5% to 5% by weight of the thermosetting resin mixture.

Suitable promoters as known in the art include dimethyl aniline, cobalt naphanate in conventional 6% metallic solution and other cobalt compounds normally used in amounts of from 0.2% to 0.6% by weight of the resin mixture. The promoters are sometimes used to speed up catalyst oxygen liberation. Promoters are not always necessary.

The above thermosetting materials are preferably of medium viscosity so that they can be incorporated in the glass fibers or other fibers used as reinforcements. In some cases it is possible to add a solvent to the materials prior to and during mixture with the fibers to enhance proper coating of the fibers after which the solvent is removed as by evaporation prior to coating with the layer 12. In some cases an additional thixotropic agent can be added such as Cab-O-Sil (a fumed silicon dioxide produced by Cabot Corp. of Boston, Mass.) from 0.5% to 4% by weight of the resin mixture. It is preferred to adjust the viscosity by styrene-polyester syrup ratios rather than use of thixotropic agents.

The thermosetting resin of the matrix can be other thermosetting materials such as epoxies, phenolic resins, silicone resins, urethanes and polyvinyls. However, each of these resin systems can have properties which are not as suitable for usage in the rope of the present invention as is the polyester monomer mixtures of the preferred embodiments.

Conventional inert fillers, pigments and the like can be added if desired.

The fibers are preferably glass fibers although other supporting fibers can be used. The glass fibers give substantial strength at low cost in small volume and thus are highly preferred. For example, tensile strengths of more than 100,000 lbs/sq. in. can be easily obtained. The fibers preferably have diameters of from 0.001 inch to 0.015 inch. Straight glass roving bundles with from 12 to 16 bundles about a center axis are preferred for use. Each bundle has approximately 60 individual strands therein with the resin mix impregnated into the strands and composite resin impregnated rope being in the order of from 0.200" to 0.375" in diameter. Other fibers can be used as for example metal fibers, polyester fibers and carbon fibers, although costs may be increased and other properties suffer. Preferably the fibers are used in amounts of from 20% to 75% of the total rope weight, and the fibers are completedly embedded within the liquid resin material used by known methods for resin-embedding glass fibers. The skin covering 12 preferably has a thickness of from 0.001" to 0.002" although it may have a thickness of from 0.0005 to 0.005 inch or more. The skin is preferably a thermoplastic resin such as polyethylene resin which has a melting point such that it will melt and fuse with the thermosetting resin upon crosslinking and polymerization when the shank is formed in the method of this invention. However, it is not necessary that the skin disappear entirely since it can become a part of the finished product substantially in the form originally in the rope. Other thermoplastic covering materials such as cellulose acetate, cellulose butyrate, polyvinyl acetate and the like can be used. In some cases, the coating or skin 12 can even be a thermosetting material such as a rubber material or a thermosetting material such as a cross-linked polyester styrene combination compatible with and bondable with the completed shank stiffener. In all cases it is preferred that the skin be impermeable to migration outwardly of the matrix and prevent inward migration or passage of materials which would adversely affect the shelf life of the stored matrix material. In addition, it is preferred that the skin be such as to allow penetration by ultraviolet light when the thermosetting matrix is to be set by ultraviolet light and also allow passage of heat to the core to initiate polymerization and cross-linking.

The skin can in some cases be formed directly on the rovings. For example a resin wetted roving rope can be sprayed with a mixture of a polyester syrup and a 2% Vicure-10 photoinitiator produced by Staffer Chemical of Edison, New Jersey and immediately treated with ultraviolet light to form a thin polyester skin. This skin performs the function of skin 12 of a thermoplastic material.

Preferably the sleeve 12 is formed of a thermoplastic material which melts at a temperature of from 175° F. to 275° F. and the matrix resin mixture cures and sets to a hard material having a flexural strength from 17000 PSI to 20000 PSI (ASTM method 790) or higher within 5 to 10 minutes after radiation exposure which produces a temperature of from 220° F. to 360° F. in the reaction mixture. Preferably the thermosetting material is polymerizable and/or cross-linkable to its final form without generating temperatures at the margins or other portions of the shoe which are adhered with thermoplastic adhesives, which temperatures are high enough to destroy the adherence of such thermoplastics.

Figure 2:
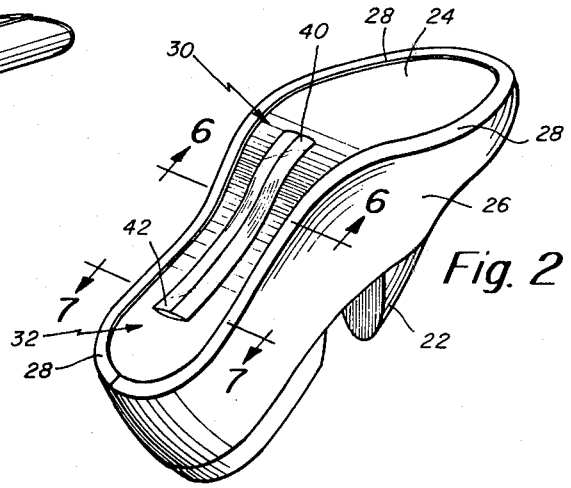
FIG. 2 is an illustration of a shoe bottom with a shank strip attached thereto.
Figure 3:
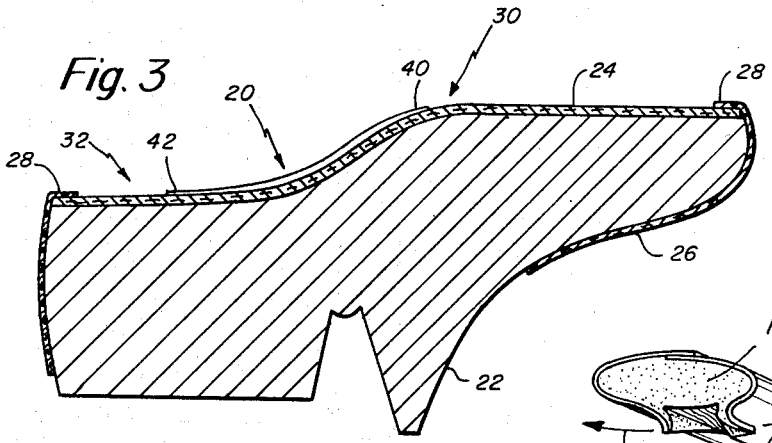
FIG. 3 is a center cross-sectional view of the shoe shown in FIG. 2.
Figure 4:
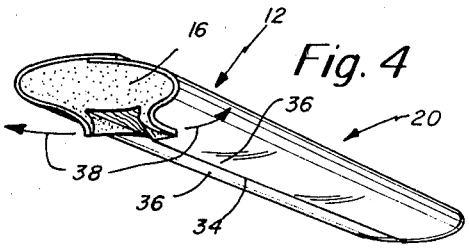
FIG. 4 is an illustration of a severed shank strip showing a longitudinal slit in its underside to facilitate exposure of the resinous matrix to the insole bottom.

FIGS. 2–7 show one manner in which a shank strip 20, cut from the rope 10, may be applied to an insole bottom to stiffen the shank region of the shoe assembly. As shown in FIG. 2, the shoe assembly in this stage of manufacture includes a last 22, an insole 24 on the last bottom and an upper 26 which has been stretched about the last 22 and has had its margin 28 firmly secured to the margin of the insole. The upper margin 28 may be attached to the insole margin by thermoplastic adhesive as is a common practice in the art.

The shank strip 20 is cut from a reeled-up rope 10 to the desired length for the particular shoe and, typically, should be cut so that when it is placed, it will extend from the ball region 30 heelwardly to the heel breast region 32. In one method of applying the shank strip 20 to the shoe assembly, the underside of the shank strip may be slit longitudinally, as suggested at 34 in FIG. 4 to define a pair of separable flaps 36 at the underside of the shank strip 20. The flaps may be spread apart as suggested by the arrows 38 and shown in FIG. 5, to expose the underside of the resinous matrix 16. The matrix 16, although flexible, is quite tacky and viscous and a film of it will adhere to the underside of the flaps 36 as suggested at 40 in FIG. 5 and when pressed against the insole, it spreads as shown in FIGS. 6 and 7. The strip 20 is applied to the insole as suggested in FIG. 5 with the resinous matrix in contact with the surface of the insole. The tackiness of the resinous matrix 16 holds the strip 20 in place. The strip 20 is pressed toward the insole bottom fully along its length to insure that its contour will correspond to that of the insole bottom. In this regard, it should be noted that the sleeve is not tacky and will not gum up the pressing tool. If desired, the ball and heel ends 40, 42 may be pressed somewhat flatter against the insole to define a feathered configuration at the ends of the strip 20 in smooth engagement with the insole bottom. This results in a reduced thickness at the ball and heel ends, where less rigidity is required.

When the resin and catalyst of which the matrix 16 is composed are activated by heat, the strip 20 can be heated in stages, including a pre-heating of the shank strip 20 after it is severed from the rope 10 but before it is applied to the bottom of the shoe assembly. For example, the shank strip 20 may be heated to approximately 150° F. (below the melt temperature of the sleeve) and is applied to the bottom of the insole in the pre-heated condition. After the shank strip 20 has been so applied, it is then exposed to additional heat to raise its temperature to activate the resin and initiate polymerization and/or cross-linking. By employing the pre-heating step, the second heating step at the higher temperature level is relatively brief to insure that no other portion of the shoe will become overheated. For example, the second heating step requires exposure to the heat source for preferably no more than between two to five seconds. Alternatively, the shank strip 20 may be applied to the insole bottom without pre-heating and the heat applied to the shank strip is localized, as will be described, with the same effect. It should be noted, however, that by employing a pre-heating stage which does not require presence of the shoe assembly, a higher production rate may be achieved and a large number of shank strips can be pre-heated at the same time.

In some cases the sleeve 12 may be stripped from the core at the point of application to the shoe assembly, either just before or after it is placed on the shoe. For example, in the shank strip shown in FIGS. 4–7, the slit sleeve 12 could be stripped away before the matrix is activated.

Figure 8:
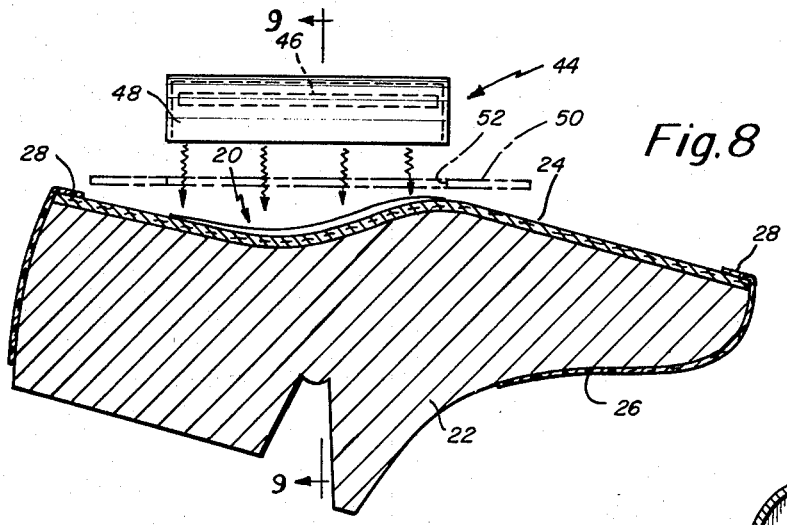
FIG. 8 is a somewhat diagrammatic illustration of the shank strip being heated by a radiant heater.
Figure 9:
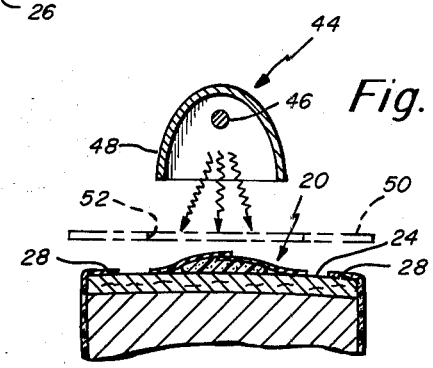
FIG. 9 is a sectional illustration as seen along the line 9—9 of FIG. 8.

FIGS. 8 and 9 illustrate a preferred technique for heating the shank strip 20 in place on the insole bottom and includes a radiant heater 44 to which the underside of the shoe assembly is exposed at the region of the shank strip 20. The heater 44 includes a quartz infrared tube 46 and a directional or focusing type of reflector 48 arranged to direct and confine the infrared radiation to the localized region of the shank strip 20. If desired, a supplemental shield 50 having an elongate opening 52 (suggested in phantom in FIGS. 8 and 9) may be disposed between the heater 44 and the shank strip 20 to further insure localized heating. The thermoplastic sleeve is preferably formed from a material which is substantially transparent to infrared radiation.

Figure 10:
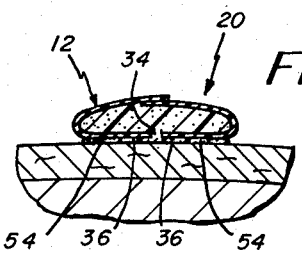
FIG. 10 is an enlarged transverse section of the shank stiffener appllied to the insole bottom with a longitudinal slit formed along the lower surface of the sleeve.

FIG. 10 shows an alternative method of placing the shank strip 20 on the insole bottom. In this technique, the shank strip is slit at its underside as suggested in FIG. 4 and is placed on the insole bottom without spreading the flaps 36. A light but firm pressure on the strip will cause some of the resinous material to be forced through the slot and between the underside of the sleeve 12 and the insole as suggested by the layer 54 in FIG. 10.

Figure 11:
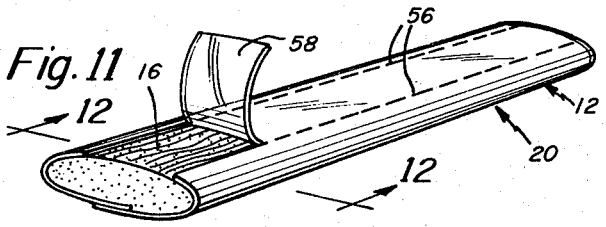
FIG. 11 is an illustration of an alternative means for exposing the thermosetting resin to the insole bottom.
Figure 12:
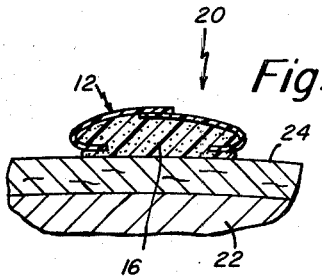
FIG. 12 is a transverse sectional illustration of the shank strip of FIG. 11 applied to the insole bottom.

FIGS. 11 and 12 show a further technique for applying the strip 20 to the insole bottom. In this technique, the underside of the strip (shown inverted in FIG. 11 for clarity) is slit longitudinally along two spaced lines indicated at 56 and the portion 58 intermediate the slits 56 is peeled off as suggested in FIG. 11. This exposes a substantial width of the matrix 16 which may be placed against the insole bottom as suggested in FIG. 12.

It should be noted that in each of the foregoing embodiments of the invention, the resinous matrix 16 of the shank strip 20 is in contact with the insole along the length of the strip which insures a firm, intimate and inseparable bond with the insole when the material has fully cured. Preferably the attachment contact is continuous along the underside of the strip, however in some cases spaced points of attachment suffice to provide sufficient bonding and reinforcement.

Figure 13:
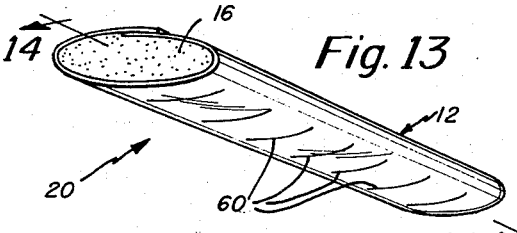
FIG. 13 is an illustration of a further technique for exposing the resin to the insole bottom.
Figure 14:
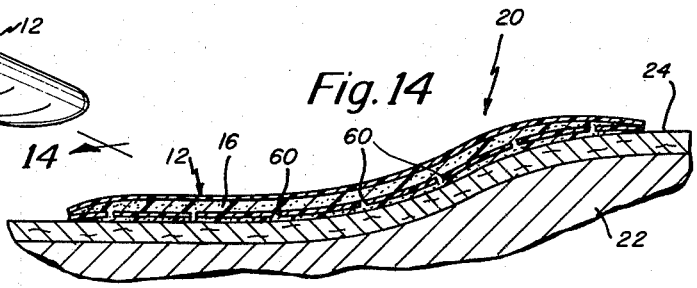
FIG. 14 is a longitudinal section illustrating the manner in which the shank strip of FIG. 13 is applied to the insole bottom.

FIG. 13 shows still another technique for effecting direct contact of the resinous matrix with the insole bottom. Here, the underside, insole-engaging surface of the sleeve 12 is provided with a plurality of generally transversely extending, longitudinally spaced slits 60 through which the resinous matrix may be extruded against the insole bottom under a light pressure. This results in the configuration shown in FIG. 14.

Figure 15:
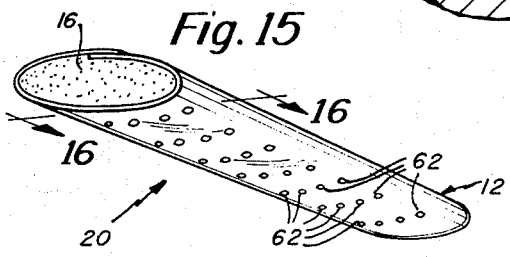
FIG. 15 shows a still further technique for exposing the resin to the insole bottom.
Figure 16:
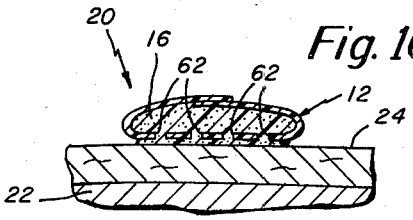
FIG. 16 is a transverse section illustrating the manner in which the shank strip shown in FIG. 15 is applied to the insole bottom.

FIG. 15 shows yet another technique in which a multiplicity of holes 62 are punched or otherwise formed in the undersurface of the sleeve 12 which, when applied to the insole bottom will permit the resinous matrix to flow against the insole bottom.

It should be noted that while the foregoing techniques for applying the shank strip to the insole bottom, in which the insole-engaging undersurface of the sleeve 12 is slit or perforated may not be essential in order to practice the invention, depending on the nature and types of thermosetting resin and thermoplastic sleeve employed. For example, FIG. 17 shows an unperforated, unslit shank strip applied directly to the bottom of the last. A light film of adhesive may be applied to the underside of the sleeve 12 merely to aid in holding the strip 20 in place on the insole. When the strip is activated, for example, at a temperature of 200° F., it will polymerize in an exothermic reaction which raises the localized heat of the strip 20 to, for example 350° F., well above the melting temperature of the thermoplastic sleeve 12. This causes the thermoplastic sleeve 12 to melt and fuse with the matrix and to become cross-linked in a single, unitary and integral mass which is firmly bonded to the insole bottom. As an alternative to preliminarily retaining the shank strip 20 by an adhesive coating, two or three small, longitudinally spaced holes may be punched in the underside of the sleeve 12 to expose a minute, but sufficient amount of tacky matrix 16 to hold the shank strip 20 in place.

In some cases adhesive can be placed on the strip or shoe part prior to placement of the strip so as to provide a bond between the two while the matrix material acts only to provide stiffening.

The foregoing method of applying the shank strip may be modified as suggested in FIGS. 18 and 19 to facilitate flattening out of the ball and heel ends 40, 42 of the shank strip 20. Here, each of the ends of the shank strip is slit at its transverse sides as shown in 64 in FIG. 18 so that when the end portions are pressed downwardly against the insole some of the matrix resin and reinforcement glass rovings can squeeze transversely out of the slots 64 as suggested in FIG. 19.

FIG. 20 shows, diagrammatically, the manner in which the rope 10 may be made. The fiberglass rovings are delivered from supply reels, indicated generally at 66. The fiberglass rovings are directed through the resin-catalyst bath 68 by a doffing bar and roller arrangement 70 and then through a pair of stripping rolls 72 to squeeze excess resinous material from the rovings. The rovings are advanced by drawing rolls 74 and then enter a continuous folding and sealing device 76 which also receives a strip of thermoplastic sleeve material which may be supplied from a roll 78 thereof. Folder/-sealer 76 encases the impregnated fiberglass strands with the sleeve material and seals the seam 18 to form the rope 10. The rope 10 is drawn from the folder/sealer 76 by another pair of drawing rolls 78' and then pass through an end cut and sealing device 80 which periodically cuts the rope and effects a seal on both sides of the cut to end one reel length of rope and begin the next reel length. A reeling device 82 winds the rope onto a reel for shipping or storage and in a form ready for use.

The following examples are illustrative of particular formulations for practicing the invention. However, these examples are non-limiting of the invention as many formulations and procedures can be used as described in this specification.

EXAMPLE 1

A rope 10 is formed with a 0.001 inch thick coating 12 of low density polyethylene having a melting point of about 235° F. with the rope being oval in cross section and having a cross sectional area of 0.072 sq.in. The matrix is formed of glass fiber rovings in 16 parallel bundles having a weight of 0.0015 to 0.0018 pounds per linear inch of rope. The resin material is a polyester syrup formed of maleic acid and a polyol sold by Reichold Chemical Co. of White Plains, New York under Number 31.000 and containing 30% to 40% by weight of styrene monomer and an inhibitor. The viscosity of the syrup is 750–1050 centipoises. One hundred grams of the syrup are admixed with 0.5 grams of an accelerator, Reichold Number DMA-0182 which is 100% dimethyl aniline and 2.0 grams of a catalyst which is a peroxy ketal produced by Lucidol Division of Pennwalt Corp., Buffalo, New York, under the trade name Lupersol 331-80B. The material is admixed with the glass rovings and then covered with a 0.001 inch thick polyethylene film 12 produced by Exxon Chemical Company, Clark, New Jersey. The film 12 is folded over the impregnated matrix with a longitudinally extending seam fused together as at 18.

An 800 foot long rope is formed which is easily bendable by hand and is coiled. The coil is used by cutting lengths of from 4 inches to 6 inches applying to a shoe as shown in FIG. 2 after first slitting along the length thereof and pressing at a pressure of from 4 oz. to 6 oz. A heater such as 44 is used to apply a radiation energy to produce an absorbed and exothermic temperature of 220° to 360° F. for 4 preheat sec. and 4 sec. final heat when the shank is on the shoe to cross-link the material and form a final shank adhered to the insole with a flexural strength of 17,000 psi.

EXAMPLE 2

In this Example, Example 1 is repeated except that the dimethyl aniline is eliminated. Substantially similar results are obtained although in some cases slightly longer final heating times are necessary in order to obtain the desired flexural strength.

EXAMPLE 3

Example 1 is repeated except that the catalyst is used in an amount of 1 gram and is t-butyl perbenzoate. A desirable adherent shoe shank is obtained.

EXAMPLE 4

Example 1 is repeated except that the resin material of that Example formed of maleic acid and a polyol is not used and in its place a polyester syrup formed of maleic acid and a polyol sold by Reichold Chemical Co. of White Plains, New York under Number 31.402 and containing 40% by weight of diallyl phthalate monomer and an inhibitor is used in its place. The viscosity of the syrup is 4000–6000 centipoise (Brookfield-77° F.). One hundred grams of this syrup are admixed with 20 grams of diallyl phthalate monomer to bring the syrup up to 50% by total weight of diallyl phthalate. A mixture of catalysts are used comprising 0.5 grams of t-butylperoctoate and 1.5 grams of t-butyl perbenzoate in place of the peroxy ketal noted in Example 1.

Figure 5:
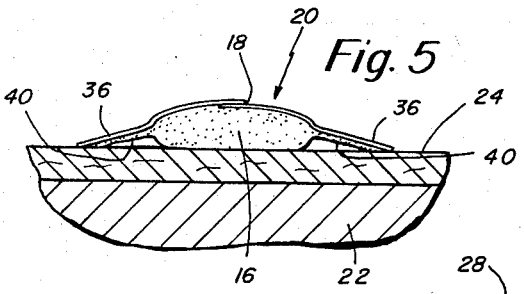
FIG. 5 is a transverse sectional elevation, enlarged, illustrating the shank strip in place on the insole bottom with the thermoplastic sleeve spread apart to expose to thermosetting resin to the insole.
Figure 6:
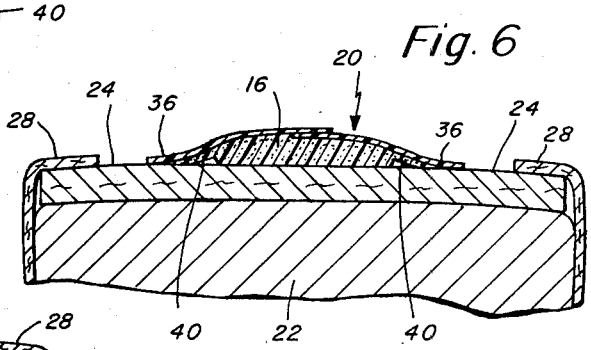
FIG. 6 is a transverse section showing the cross-sectional configuration of the shank piece on the shoe as seen along the line 6—6 of FIG. 2.
Figure 7:
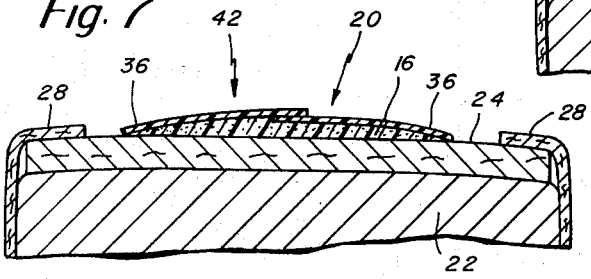
FIG. 7 is a transverse sectional illustration showing the flattened ends of the shank strip on the insole bottom as seen along the line 7—7 of FIG. 2.

In this Example, the shank is split and applied as shown in FIGS. 5–7.

The heater 44 is used to apply radiant energy to produce an absorbed exothermic temperature of from 250° to 360° F. for 8 preheat seconds and 4 final heat seconds. That is, the strip is preheated before application to the shoe for 8 seconds and heated on the shoe for 4 seconds. The final shank is adhered to the insole and has a flexural strength exceeding 18000 psi.

EXAMPLE 5

Example 1 is repeated except that the resin material is a polyester syrup sold by American Cyanamid of Wellingford, Connecticut as Laminac polyester resin 4202 containing 30 to 40% diallyl phthalate monomer. The viscosity of the syrup is 1350 poise (Brookfield Model RVF Spindle No. 7, 10 rpm 77°) and is temporarily reduced during impregnation into the glass rovings by the addition of a solvent. One hundred grams of this polyester syrup is admixed with 40 grams of trichloroethylene and 1.0 grams of a peroxy ester catalyst, i.e. t-butyl perbenzoate. This mixture is impregnated into the glass roving bundles at a very low wet viscosity to form a glass resin rope. The trichloroethylene is then removed by heating the rope in an evaporation chamber at a temperature between 150° and 180° F. The result is a very dry rope which can be covered with the polyethylene and then applied as previously described.

EXAMPLE 6

Example 1 is repeated except that the rope formed is cut to remove a 6 inch length which is then applied to the insole. Here the rope is perforated and applied as described in FIG. 12. A structurally strong final shank is obtained.

EXAMPLE 7

A rope 10 is formed with a 0.001 inch thick coating 12 of polyethylene having a melting point of 240° F. with the rope being oval in cross section and having a cross sectional area of 0.072 square inches.

The matrix is first formed of glass fiber rovings in 12 parallel bundles having a weight of 0.0015 pounds per linear inch of rope. The resin material is a polyester syrup formed of maleic acid and a polyol sold by Reichold Chemical Co. of White Plains, New York under Number 90-569 containing 30–40% by weight of styrene monomer, an inhibitor and a benzoin ether photosensitizer. The viscosity of the resin syrup is 400°–500° Centipoise 77° F. Brookfield. One hundred grams of the syrup is admixed with 20 grams of styrene monomer to reduce the final viscosity. The material is admixed with the glass rovings and the polyethylene film applied as described in Example 1.

A 5 inch length of polyethylene sleeved rope is flattened to 0.090 inches in thickness and placed on the shank area of a shoe insole. Two inches away from the rope is placed a 5 kilowatt input ultraviolet radiation unit. After 5 seconds, the radiation cycle produces a stiff shank piece which when cooled to room temperature after reaching an exothermic temperature of 275° F., provides a structurally strong adherent shoe shank.

In other examples of this invention, the glass fiber rovings can be varied in number and weight to vary the strength of the final shoe shank. In some cases fillers such as ¼ inch long chopped glass fibers can be added to again increase structural strength. In all cases it is preferred that the polyesters are formulated to be 100% reactive preferably with small quantities of peroxide catalyst activating the unsaturated liquid thermosetting resins to form tough solid plastics at elevated temperatures with no unwanted by-products formed.

While specific embodiments of the present invention have been shown and described, many variations are possible. For example, the term "rope" or "article" as used herein can refer to preformed lengths of rope conforming to the size of a shank to be used. For example, the rope can be cut in lengths of 3 inches, 4 inches and 5 inches and used of varying sized shoes when needed rather than stocked as a coil. The lengths can be sealed at either end as by an end cap of thermoplastic material formed thereover just as the skin coating or sleeve 12 is formed. The temperature used to heat the matrix in order to activate it is preferably in the range of from 225° to 275° F. although other temperatures can be used. In the case of ultra violet radiation, no elevated activating temperature is employed.

It should be understood, however, that the foregoing description of the invention is intended merely to be illustrative thereof and that other modifications and embodiments may be apparent to those skilled in the art without departing from its spirit.

Having thus described the invention, what we desire to claim and secure by Letters Patent is:

1. A method for stiffening the shank region of the shoe insole comprising:

applying a shank strip to the insole, said shank strip including a flexible sleeve containing a flexible matrix of externally activatable thermosetting resin, said sleeve and matrix being flexible and deformable, as a unit, to enable the shank strip to be applied to the shank region of the insole and to substantially conform to the shank region of the insole while in an unactivated condition;

urging said shank strip into engagement with the shank region of the insole to cause the shank strip to substantially conform to the contour of the shank region of the insole; and activating the resin in situ on the insole to form a reinforcing shoe shank.

2. A method for stiffening the shank region of an insole as defined in claim 1 further comprising:

said sleeve being formed from a material which is degradable at a predetermined temperature;

said resin selected to polymerize in an exothermal reaction and being selected to develop heat sufficient to degrade the sleeve.

3. A method for stiffening the shank region of an insole as defined in claim 1 wherein said step of activating the resin comprises applying heat to the shank strip and wherein said resin is selected so to cure in an exothermal reaction, said sleeve being thermoplastic and having a melt temperature which is no higher than the temperature generated in said activating step.

4. A method as defined in claim 1 wherein said step of activating the resin comprises exposing the shank strip to radiant energy of a character adapted to heat the resin, said sleeve allowing passage of said radiant energy; and confining the exposure of said radiant energy substantially to the local portion of the insole where said strip is located.

5. A method for stiffening the shank region of a shoe insole as defined in claim 4 wherein said radiation comprises infrared radiation.

6. A method for stiffening the shank region of a shoe insole as defined in claim 4 wherein said radiation comprises ultraviolet radiation.

7. A method for stiffening the shank region of a shoe insole as defined in claim 1 wherein said thermosetting resin is heat activatable, said method further comprising:

before applying the strip to the insole, preheating said strip to a temperature level below the polymerization temperature of the resin;

thereafter applying the strip to the insole in its preheated state; and thereafter further heating the strip to elevate its temperature to the polymerization temperature.

8. A method for stiffening the shank region of a shoe insole as defined in claim 1 further comprising:

as a preliminary step to applying the strip to the insole, forming an opening in the insole-engaging surface of the sleeve to enable some of the resin to contact the insole when the sleeve is applied to the insole thereby retaining the strip in place on the insole and enabling direct bonding to the resin to the insole.

9. A method as defined in claim 8 further comprising forming a longitudinally extending slit along the insole-engaging surface of the sleeve to expose the resin to the insole.

10. A method as defined in claim 8 further comprising forming a plurality of longitudinally spaced, transversely extending slits in the insole-engaging surface of the sleeve to expose the resin to the insole.

11. A method as defined in claim 8 further comprising forming a plurality of holes in the insole-engaging surface of the sleeve to enable the resin to engage the insole.

12. A method as defined in claim 8 further coprising removing a longitudinally extending strip portion from the insole-engaging portion of the sleeve to enable direct contact of the resin with the insole bottom.

13. A method as defined in claim 9 further comprising:

spreading apart the portions of the sleeve on the insole-engaging region thereof to fully expose the resin and then placing the spread-apart strip, resin-down on the insole.

14. A method for stiffening the shank region of a shoe insole as defined in claim 1 further comprising causing the sleeve to lightly adhere to the insole concurrently with said step of applying said strip to the insole.

15. A method for stiffening the shank region of a shoe insole comprising:

applying a strip of heat activatable, thermosetting resin having a multiplicity of glass fibers extending longitudinally therein to the shank region of the insole; and exposing said strip locally to heat from a radiant source thereof and confining the exposure of said radiant heat to the local region of said strip.

16. A method as defined in claim 15 wherein said exposure is controlled by reflector means contoured to confine the direction of radiation to that region defined by the strip.

17. A method as defined in claim 15 wherein the exposure is confined by interposing a shield between the source of radiant energy and the shoe insole, said shield having an aperture formed therein to permit radiant energy to reach only said strip.

18. A method for stiffening shank region of a shoe insole as defined in claim 1 further comprising:

as a preliminary step, providing an elongate supply of said shank strip;

severing a length of said shank strip material;

thereafter applying said shank strip to the insole.

19. A method for stiffening the shank region of a shoe insole comprising:

providing a selected length of a sleeve having a thermosetting resin therein and a multiplicity of glass fibers embedded in the resin;

slitting the sides of the sleeve at each end of the sleeve;

applying said strip to the insole;

pressing said strip to the insole to conform the strip to the contour of the insole and flattening the ends of the strip to feathered merging with the insole; and activating the resin.

20. A method for stiffening a selected portion of a shoe assembly comprising:

applying a flexible sleeve containing a fluent matrix of externally activatable thermosetting resin to the selected region of the shoe assembly, said sleeve and matrix being flexible and deformable as a unit to enable it to substantially conform to the contour of the selected surface of the shoe assembly while in an unactivated condition;

urging said sleeve and matrix into engagement with the contour of the selected region of the shoe assembly to cause it to substantially conform to said contour; and activating the resin in situ form a thermoset stiffening member.

21. A method as defined in claim 20 wherein said selected portion of the shoe assembly comprises the shank region thereof.

22. A method for forming a shank stiffener for a shoe assembly comprising:

providing a shank strip having a flexible sleeve which contains a fluent matrix of externally activatable thermosetting resin, said sleeve and matrix being flexible as a unit to enable it to conform to the contour of a selected surface of a shoe assembly;

urging the shank strip into engagement with a surface having said selected contour to substantially conform the sleeve and resin to said contour; and activating the resin while it is maintained in said contour.

23. A method for stiffening a selected region of a shoe assembly comprising:

applying to the selected region of the shoe assembly, a flexible sleeve containing a fluent externally activatable resin material, said sleeve and matrix being flexible and deformable, as a unit, to enable it to substantially conform to the contour of the selected region of the shoe assembly;

urging said sleeve toward and into engagement with the selected region of the shoe assembly to cause it to substantially conform to the contour of the selected region;

then pressing at least one selected portion of the sleeve to flatten the selected portion to a feathered configuration; and then activating the resin.

24. A method as defined in claim 23 wherein said step of pressing the selected portion of the sleeve comprises pressing said portion sufficiently to cause some of the fluent resin material to be urged out of the sleeve into direct contact with the surface of the shoe assembly.

25. A method as defined in claim 24 further comprising:

said matrix including a multiplicity of glass fibers embedded in the resin.

26. A method as defined in claim 24 wherein the sleeve has openings at each of its ends and wherein each of said ends are pressed into said flattened configuration.

27. A method for stiffening the shank region of a shoe insole comprising:

providing a selected length of a sleeve having a fluent resin therein, said sleeve and resin being flexible and deformable as a unit to enable it to substantially conform to the contour of the shank region of the bottom of the insole while in an unactivated condition;

said sleeve having an opening formed at least at one of its ends;

applying said sleeve to the bottom of the insole and urging the sleeve into engagement with the shank region of the insole to cause the sleeve to substantially conform to the contour of the insole;

pressing said at least one end of the sleeve against the insole bottom to flatten the end of the sleeve and to cause a portion of the resin to flow out of the sleeve into direct contact with the insole; and activating the resin.

28. A method as defined in claim 27 wherein the sleeve is open at both its ends.

29. A method as defined in claim 28 wherein the openings in the ends of the sleeve are formed, at least in part, by slits extending along the sides of the sleeve at each end thereof.

* * * * *

UNITED STATES PATENT AND TRADEMARK OFFICE

CERTIFICATE OF CORRECTION

PATENT NO. : 4,236,268

DATED : December 2, 1980

INVENTOR(S) : Robert W. Bradley et al

It is certified that error appears in the above—identified patent and that said Letters Patent is hereby corrected as shown below:

| Column | Line | |
|---|---|---|
| 1 | 44 | "from" should be --for-- |
| 2 | 29 | "to" should be --of-- |
| 2 | 51 | "head" should be --heat-- |
| 3 | 7 | "beating" should be --heating-- |
| 5 | 2 | "appllied" should be --applied-- |

Signed and Sealed this

First Day of September 1981

[SEAL]

*Attest:*

GERALD J. MOSSINGHOFF

*Attesting Officer*

*Commissioner of Patents and Trademarks*